US007318418B2

(12) United States Patent
Usui et al.

(10) Patent No.: US 7,318,418 B2
(45) Date of Patent: Jan. 15, 2008

(54) COMMON RAIL FOR DIESEL ENGINE

(75) Inventors: Shoichiro Usui, Numazu (JP); Masayoshi Usui, Numazu (JP); Yasuji Sakamoto, Izunokuni (JP); Eiji Watanabe, Shizuoka (JP); Yasuaki Hashimoto, Izu (JP)

(73) Assignee: Usui Kokusai Sangyo Kaisha Limited (JP)

( * ) Notice: Subject to any disclaimer, the term of this patent is extended or adjusted under 35 U.S.C. 154(b) by 0 days.

(21) Appl. No.: 11/342,031

(22) Filed: Jan. 27, 2006

(65) Prior Publication Data

US 2006/0169253 A1 Aug. 3, 2006

(30) Foreign Application Priority Data

Jan. 28, 2005 (JP) ..... 2005-022308
Jan. 16, 2006 (JP) ..... 2006-007998

(51) Int. Cl.
*F02M 55/02* (2006.01)
*F02M 55/00* (2006.01)

(52) U.S. Cl. ..... 123/468; 123/456

(58) Field of Classification Search ..... 123/468, 123/469, 470, 456; 285/133.11, 133.4, 334, 285/197

See application file for complete search history.

(56) References Cited

U.S. PATENT DOCUMENTS 4,087,038 A * 5/1978 Yagi ..... 228/114.5
4,832,376 A 5/1989 Sugao
4,893,601 A 1/1990 Sugao
4,900,180 A 2/1990 Takikawa
5,120,084 A 6/1992 Hashimoto
5,143,410 A 9/1992 Takikawa
5,169,182 A 12/1992 Hashimoto
5,172,939 A * 12/1992 Hashimoto ..... 285/24
5,667,255 A * 9/1997 Kato ..... 285/133.4
5,887,910 A 3/1999 Usui
5,903,964 A 5/1999 Uematsu et al.
5,957,507 A 9/1999 Asada
5,979,945 A 11/1999 Hitachi et al.
5,992,904 A 11/1999 Hitachi et al.
6,050,611 A 4/2000 Asada
6,070,618 A 6/2000 Iwabuchi
6,126,208 A 10/2000 Asada et al.
6,397,881 B1 6/2002 Asada et al.
6,408,826 B2 6/2002 Asada et al.
6,415,768 B1 7/2002 Usui
6,463,909 B2 10/2002 Asada et al.
6,494,183 B2 12/2002 Usui et al.
6,554,177 B2 * 4/2003 Foster et al. ..... 228/112.1
6,840,283 B2 1/2005 Furugen et al.
6,843,275 B2 1/2005 Kato
6,918,378 B2 7/2005 Usui et al.
6,935,377 B2 8/2005 Furugen
2004/0080156 A1 * 4/2004 Usui ..... 285/133.11
2005/0127665 A1 * 6/2005 Usui et al. ..... 285/197

FOREIGN PATENT DOCUMENTS

JP 2-80289 6/1990
JP 3-177693 8/1991
JP 4-175462 6/1992
JP 6-109191 4/1994
JP 9-236064 9/1997
JP 9-280460 10/1997

* cited by examiner

*Primary Examiner*—Mahmoud Gimie
(74) *Attorney, Agent, or Firm*—Gerald E. Hespos; Anthony J. Casella

(57) ABSTRACT

A common rail a diesel engine includes a branching connection body firmly fixed on common rail body by friction welding. A fronting face of the branching connection body to be fixed on the common rail body by friction welding is in the shape of a cone whose center part is slightly projected and whose peripheral part is a gentle cone face.

14 Claims, 15 Drawing Sheets

COMMON RAIL FOR DIESEL ENGINE

BACKGROUND OF THE INVENTION

1. Field of the Invention

The present invention generally relates to a common rail such as a high-pressure fuel manifold in an accumulator system fuel injection system of a diesel internal combustion engine, and particurally, relates to a common rail for a diesel engine made by firmly fixing a branching connection body to a common rail body by a frictin welding (a friction pressure welding).

2. Description of Related Art

As a common rail for a diesel engine, one having a common rail body integrally formed with a branching connection body by a forging method or one having a common rail body connected to a branching connection body (a branching connection fitting) by a welding method (including a friction wielding method) has been known. Among them, as a common rail for a diesel engine in a system of integrally manufacturing a common rail body and a branching connection body by the forging method, for example, a common rail (refer to JP-A-6-109191) as shown in FIG. 21 has been known, in which a short tubular wall (a branching connection body) 21-2 is integrally projected at a peripheral wall in an axial direction of a common rail body 21 made of hot forging of a solid core round bar material; a through hole 21-3 communicated with a distribution hole 21-2 bored on the common body 21 by a gun drill or the like is formed on this tubular wall 21-1; a pressure bearing surface 22-2 made by a connection head 22-1 of a branch tube 22 supplying a fuel to an injection nozzle (not illustrated) of each cylinder engine is abutted and joined to a pressure receiving bearing surface 21-4 opening to the outside that is disposed at the front end of the through hole 21-3; and a nut for fastening (a hexagon cap nut) 23 incorporated in the side of the branch tube 22 in advance is screwed together in the tubular wall 21-1. Thereby, this common rail is fastened and connected due to the pressure under the neck of the connection head 22-1.

In addition, as a common rail for a diesel engine in a system of connecting the branching connection body (a branching connection fitting) to the common rail body by the welding method, for example, a common rail (refer to JP-A-9-236064 and JP-A-9-280460) as shown in FIG. 22 has been known, in which a through hole 31-2 communicated with a distribution hole 31-1 of a common rail body 31 is formed at an outer circumferential face in an axial direction of the common rail body 31 made of a thick steel pipe; a branching connection body (a branching connection fitting) 34 having a through hole 34-1 communicate with this through hole 31-2 formed thereon is pressure-bonded (it is pressure-bonded in as a whole, however, it may partly melt and be fusion-bonded) by a projection welding or a TIG welding or an ark such as a plasma or as shown in FIG. 23, by a friction welding (a friction pressure bonding); the pressure bearing surface 22-2 made by the connection head 22-1 of the branch tube 22 supplying the fuel to the injection nozzle (not illustrated) of each cylinder engine is abutted and jointed to a pressure receiving bearing surface 34-2 opening to the outside that is disposed at the front end of the through hole 34-1 of the branching connection body (the branching connection fitting) 34; and a nut for fastening (a hexagon cap nut) 23 incorporated in the side of the branch tube 22 in advance is screwed together in the branching connection body (the branching connection fitting) 34.

Thereby, this common rail is fastened and connected due to the pressure under the neck of the connection head 22-1.

However, in the case of the common rail in the system of fusion-bonding the branching connection body (the branching connection fitting) to the common rail body by a projection welding or a TIG welding or an ark such as a plasma as shown in FIG. 22 among the above-described common rails for the diesel engine, a fusion nugget 35 is disposed at a welding part, and an intense stress is generated at a boundary with a no-fusion part upon congelation in this welding part. Therefore, this common rail has a problem such that there is a high possibility that a crack is generated in association with the stress due to the external force or this common rail is destroyed, and the fusion part itself has a poor reliability with respect to the outer force such as oscillation, the inner pressure, and bending because its ligament force is decreased. In addition, in the case of the common rail in the system of firmly fixing the branching connection body (the branching connection fitting) to the common rail body by the friction welding (the friction pressure welding), as shown in FIG. 23, confronting the branching connection body (the branching connection fitting) 34 to a flat surface 31-3 formed on the outer face of the common rail body 31, the branching connection body is bonded to the common rail body by means of heat generation due to the friction between one flat face and the other flat face and upset. Therefore, there is a case that a squeeze-out affect of efficiently discharging a stain on a bonding part and an oxide or the like to the outside of the bonding part cannot be sufficiently obtained, so that there is a high possibility that carbide, an oxide, and a void or the like remain at the bonding part. Therefore, as same as the above case, this involves a problem such that a reliability of the bonding part with respect to the outer force such as oscillation, the inner pressure, and bending is poor.

SUMMARY OF THE INVENTION

The invention is made in order to solve the above-described problem of the common rail in the system of firmly fixing the branching connection body (the branching connection fitting) to the common rail body by the friction welding (the friction pressure welding) and the invention provides a common rail for a diesel engine, which can obtain a clean pressure bonding connection fabric of efficiently squeezing out inclusion such as a stain and an oxide and is provided with the bonding part having an excellent durability against the outer force such as oscillation, the inner pressure, and bending.

The common rail for the diesel engine according to the invention is in a system of firmly fixing a branching connection body which fastens a branch tube for supplying a fuel to an injection nozzle of each cylinder engine by a nut to a common rail body made of a thick steel tube or a solid core round bar by friction welding, wherein a fronting face of the common rail body of the branching connection body to be firmly fixed on a branching connection body fixed face shaped in a flat face that is formed on the common rail body by the friction welding is formed in the shape of a cone with a head mounted thereon whose center part is slightly projected and whose peripheral part is a gentle cone face.

In addition, according to the invention, it is possible that the cone face of the cone with a head mounted thereon is made into a gentle flat face or a gentle curved face. Further, it is preferable that, in the case that the diameter of the flat face of the cone with a head mounted thereon is defined as d and the diameter of the branching connection body is defined as D, the diameter d of the flat face is ⅗ of D to ⅘ of D.

Furthermore, the invention is characterized by having a pressure flange part, whose diameter is larger than the outer diameter of the branching connection body, at the common rail body confronting part of the branching connection body; wherein, the common rail body confronting part of the branching connection body is formed in the shape of a cone with a head mounted thereon, whose center part is slightly projected and whose peripheral part is made into a gentle cone face. Also in the case of this common rail, as same as the above-described case, it is possible that the cone face in the shape of the cone with the head mounted thereon of the pressure flange part is made into a gentle flat face or a gentle curved face and it is preferable that, in the case that the diameter of the flat face of the cone with the head mounted thereon of the pressure flange part is defined as d1 and the diameter of the pressure flange part is defined as D1, the diameter d1 of the flat face is ⅗ of D to ⅘ of D.

In the meantime, it is preferable that an angle θ of the cone face of the cone with the head mounted thereon according to the invention is 5 to 10 degrees.

Further, the invention is characterized in that an annular concave part is formed at a part confronting to the outer end face of the branching connection body of the branching connection body fixed face of the common rail body, whose concave face is made into a gentle flat face or a gentle curved face.

In addition, the invention is characterized by having a facing hole with a diameter larger than the diameter D of the connection face of the branching connection body by 3 to 4 mm and with a depth of 1 to 2 mm on the branching connection body fixed face made into a flat face of the common rail body.

Furthermore, the common rail for the diesel engine according to the invention is characterized by having a projection in the shape of a cone with a head mounted thereon at a center portion of a branching connection body fixed face made into a flat face that is formed on the common rail body and having a concave part in the shape of a cone with a head mounted thereon, whose opening diameter, bottom diameter, and depth are slightly smaller than those of the projection which fits into the projection in the shape of the cone with the head mounted thereon, at a center of a branching connection body end face.

In addition, further, the common rail for the diesel engine according to the invention is characterized by having a concave part in the shape of an inversed cone with a head mounted thereon at a center portion of a branching connection body fixed face made into a flat face that is formed on the common rail body and having a projection in the shape of an inversed cone with a head mounted thereon, whose base diameter, end face diameter, and height are slightly larger than those of the concave part which fits into the concave part in the shape of the inversed cone with the head mounted thereon, at a center of a branching connection body end face. Further, the common rail for the diesel engine according to the invention is characterized by having a flat face in an inner peripheral wall face of a branching connection body fixed part of a common rail body, wherein a branching connection body is made of high fatigue strength steel. In the meantime, in this common rail for the diesel engine, in order to obtain a more clean pressure bonding connection fabric, it is preferable that a through hole for air release and pooling the inclusion or a pool for air and the inclusion is disposed at least one of the branching connection body or the common rail body upon friction welding.

In the common rail for the diesel engine according to the invention, due to the effect of a conical face in the shape of a gentle cone with a head mounted thereon that is disposed at the side of a branching connection body or the effect of a concave part with a gentle annular conical face that is disposed at the side of a common rail body, a gap is formed at an end face at the outer circumference side between the confronting faces of a flat face at the side of the common rail body and the branching connection body or at the end face at the outer circumference side between the confronting faces of the branching connection body and the common rail body. Thereby, the pressure bonding has been progressed and has been completed as a red heat soft surface layer (the inclusion such as stain and an oxide) is effectively squeezed-out due to upset from a friction rotation center part from the gap sufficiently causing heat generation by friction, so that a clean pressure bonding connection fabric can be obtained and the common rail for the diesel engine according to the invention is provided with a bonding part having an excellent durability against the outer force such as oscillation, the inner pressure, and bending.

In addition, in the case of the common that firmly fixes the branching connection body to the common rail body by the friction welding by employing a fitting system for a projection of the cone with the head mounted thereon that is disposed at the side of the common rail body and the concave part of the cone with the head mounted thereon that is disposed at the side of the branching connection body and a fitting system for the concave part of an inversed cone with a head mounted thereon that is disposed at the side of the common rail body and the projection of the inversed cone with the head mounted thereon that is disposed at the side of the branching connection body, the further improvement of the strength of the bonding part is realized by the mutual insertion of pressure bonding layers.

Further, if upon friction welding a through hole for air release and an inclusion pool or a pool part for air and the inclusion is disposed at a least one of the branching connection body or the common rail body, a more clean pressure bonding connection fabric can be obtained.

BRIEF DESCRIPTION OF THE DRAWINGS

FIG. 1*a* is a front view showing a branching connection body formed in the shape of a cone with a head mounted thereon whose confronting face of a common rail body has a taper face made into a flat face; and FIG. 1*b* is a front view showing a branching connection body formed in the shape of a cone with a head mounted thereon whose confronting face of a common rail body has a taper face made into a gentle curved face.

FIG. 2*a* is a front view showing a branching connection body formed in the shape of a cone with a head mounted thereon whose confronting face of a common rail body of a pressure flange part that is disposed at the confronting part of the common rail body has a taper face made into a flat face; and FIG. 2*b* is a front view showing a branching connection body formed in the shape of a cone with a head mounted thereon whose confronting face of a common rail body of a pressure flange part that is disposed at the confronting part of the common rail body has a taper face made into a gentle curved face.

FIG. 13*a* is a substantial part sectional view showing the setup state; and FIG. 13*b* is a substantial part sectional view showing the common rail after the friction welding.

DESCRIPTION OF PREFERRED EMBODIMENTS

Figure 1A:
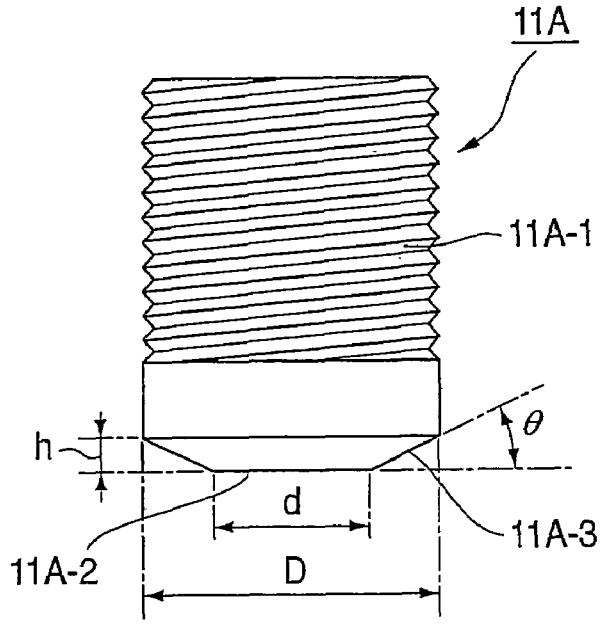
FIGS. 1*a* and 1*b* illustrate an embodiment of a branching connection body according to the invention.
Figure 1B:
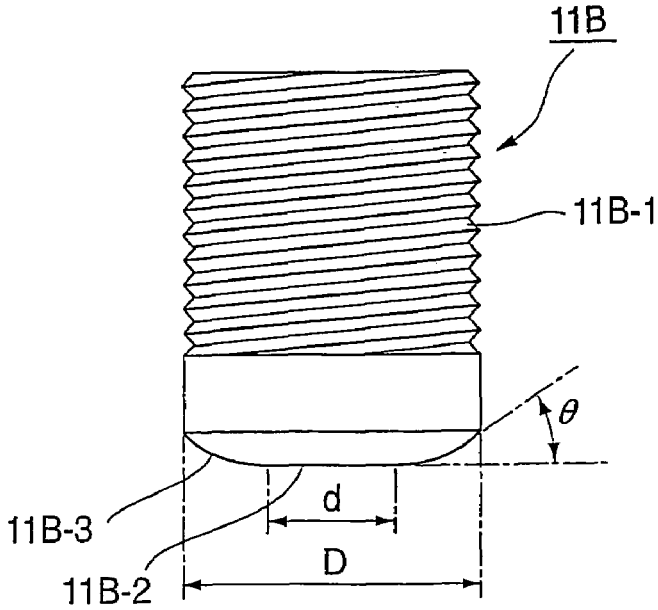
Figure 2A:
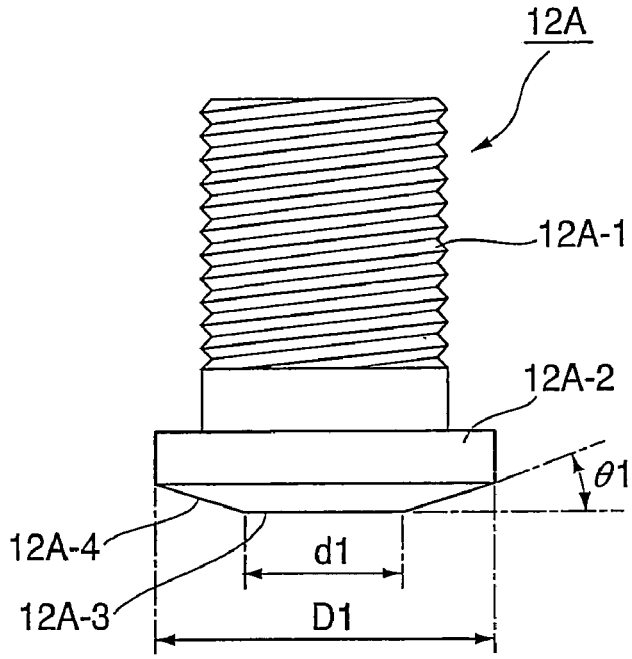
FIGS. 2*a* and 2*b* illustrate the other embodiment of the branching connection body likewise.
Figure 2B:
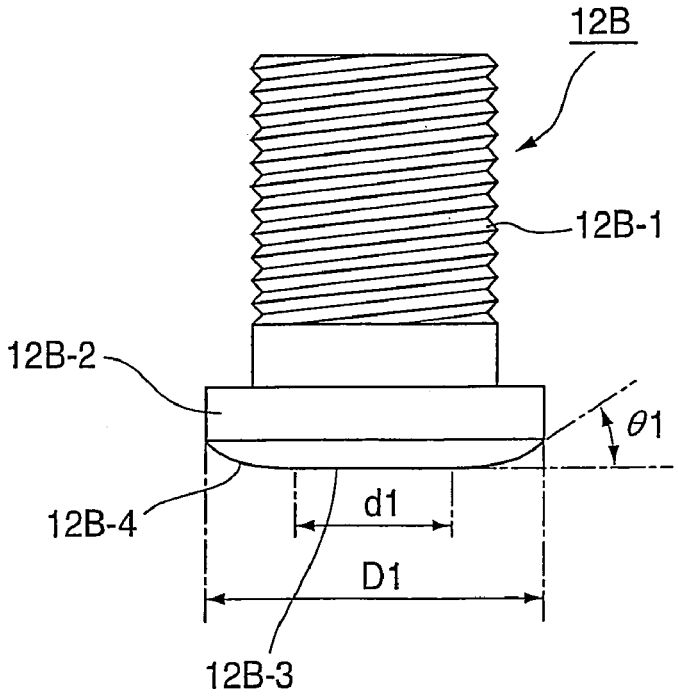
Figure 3:
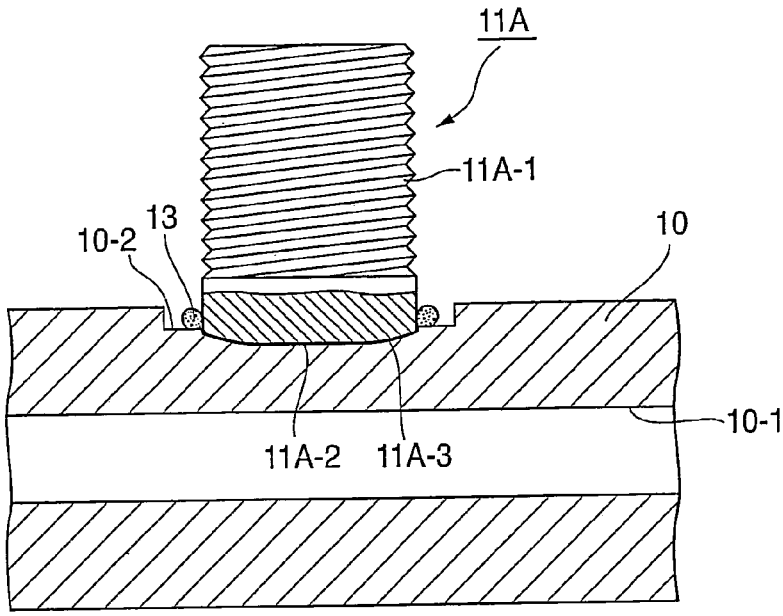
FIG. 3 is a substantial part sectional view showing a first embodiment of a common rail according to the invention.
Figure 4:
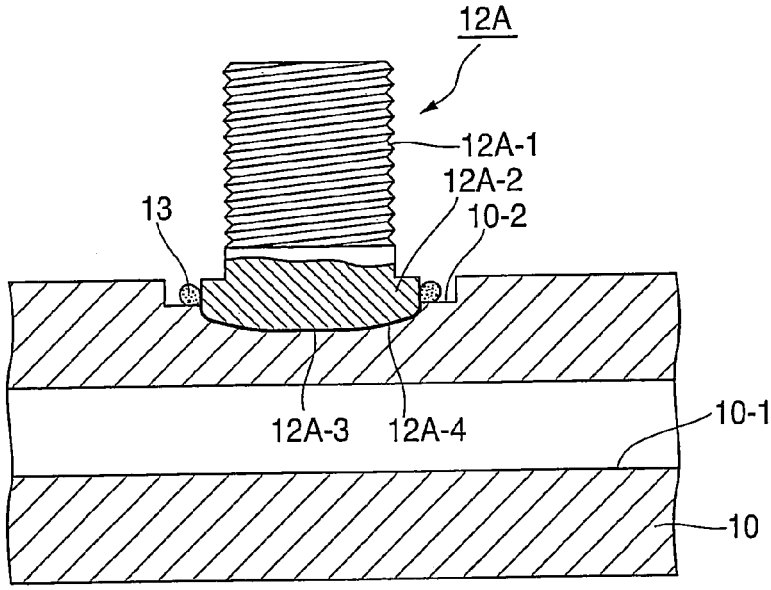
FIG. 4 is a substantial part sectional view showing a second embodiment of the common rail according to the invention.
Figure 5:
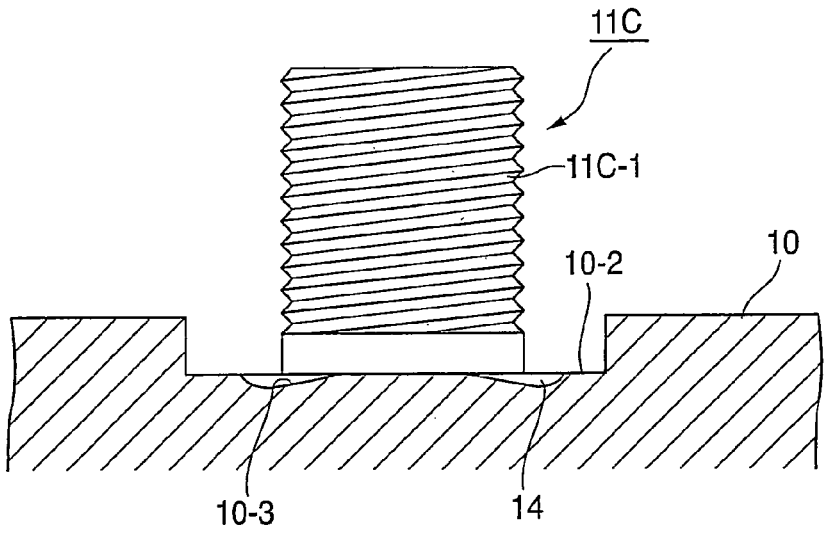
FIG. 5 is a substantial part sectional view showing a third embodiment of the common rail according to the invention.
Figure 6:
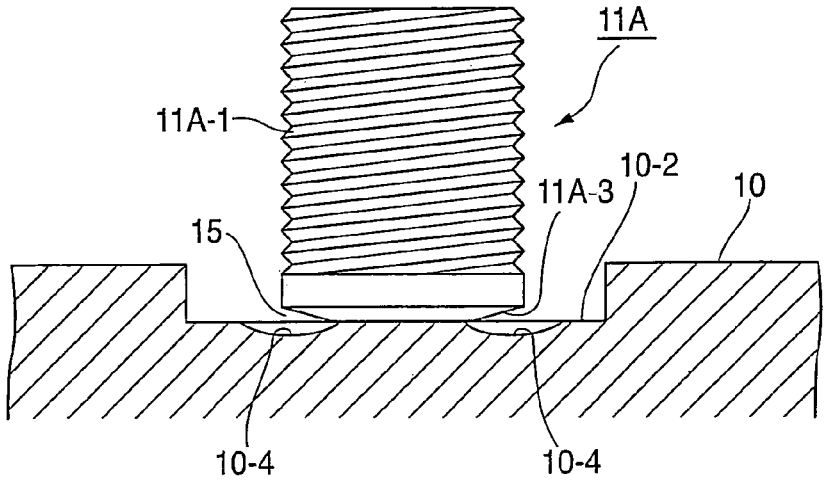
FIG. 6 is a substantial part sectional view showing a forth embodiment of the common rail according to the invention.
Figure 7:
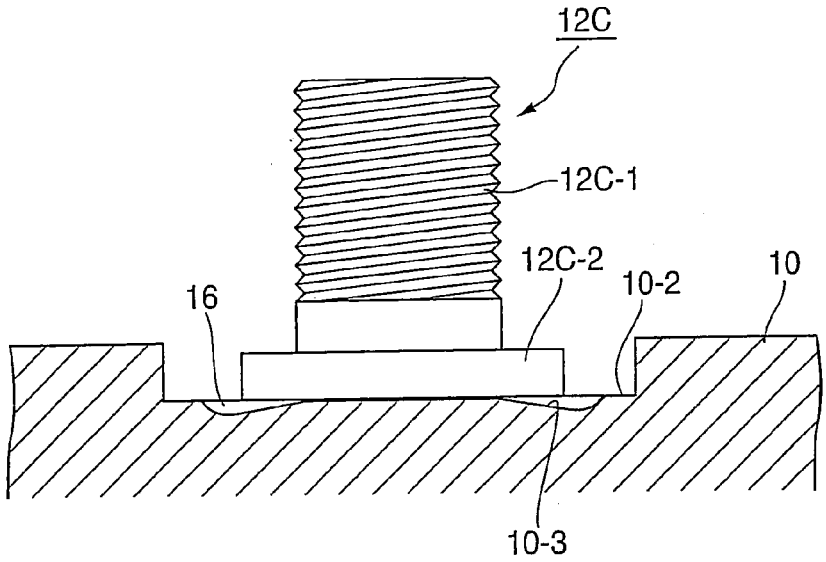
FIG. 7 is a substantial part sectional view showing a fifth embodiment of the common rail according to the invention.
Figure 8:
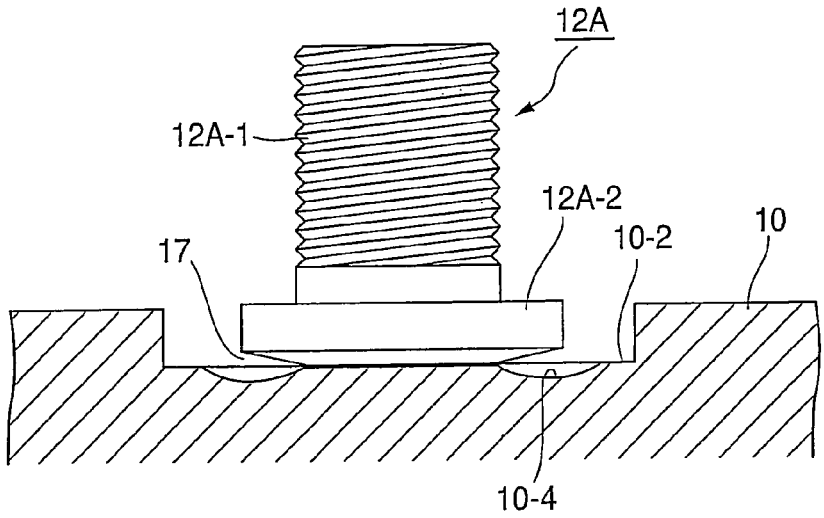
FIG. 8 is a substantial part sectional view showing a sixth embodiment of the common rail according to the invention.
Figure 9:
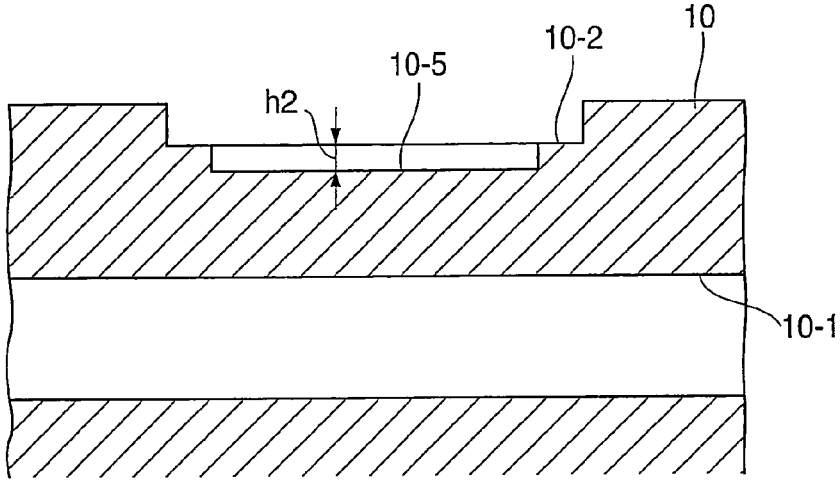
FIG. 9 is a substantial part sectional view showing the other embodiment of the common rail body according to the invention.
Figure 10:
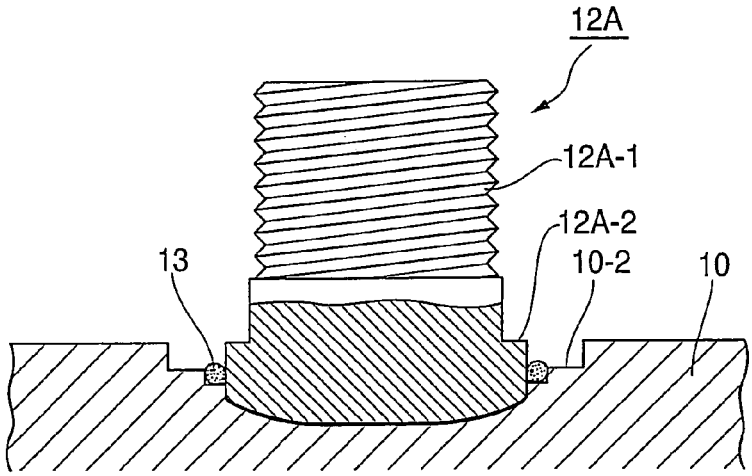
FIG. 10 is a sectional view showing a seventh embodiment of the common rail according to the invention.
Figure 11:
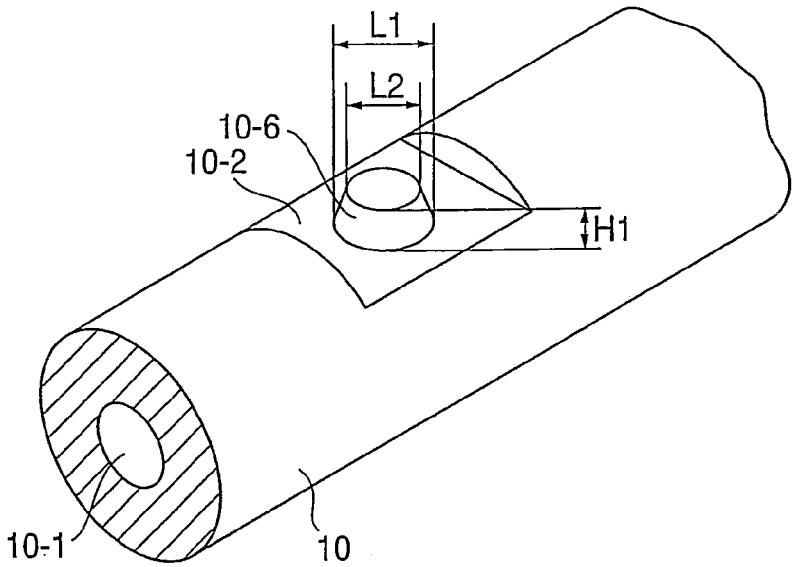
FIG. 11 is a perspective view of a substantial part showing the other embodiment of the common rail body according to the invention.
Figure 12:
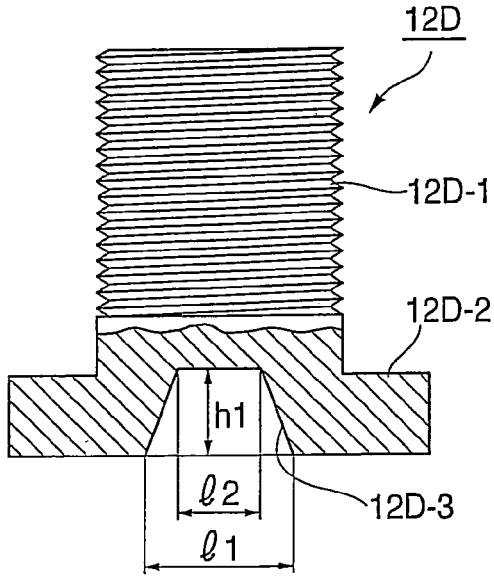
FIG. 12 is a front view showing a branching connection body pairing the common rail body shown in FIG. 11 being partially broken.
Figure 13A:
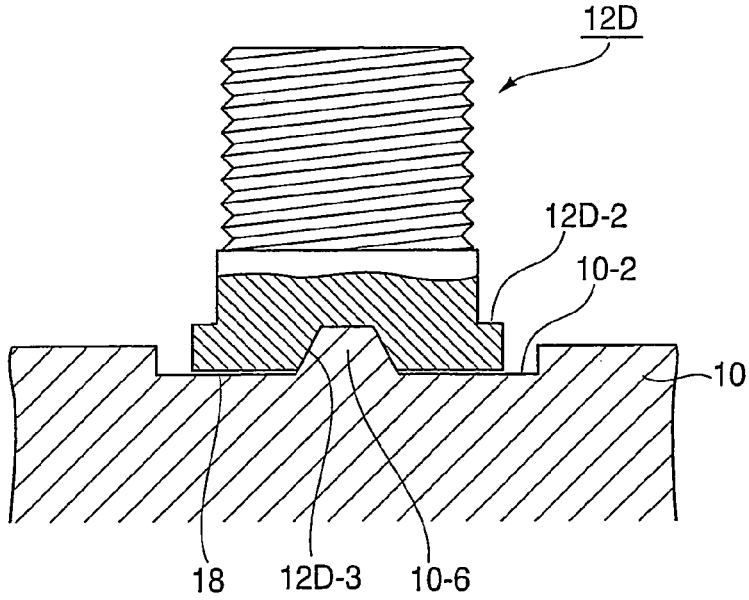
FIGS. 13*a* and 13*b* are views showing an eighth embodiment of the common rail according to the invention that is configured by the common rail body shown in FIG. 11 and the branching connection body shown in FIG. 12.
Figure 13B:
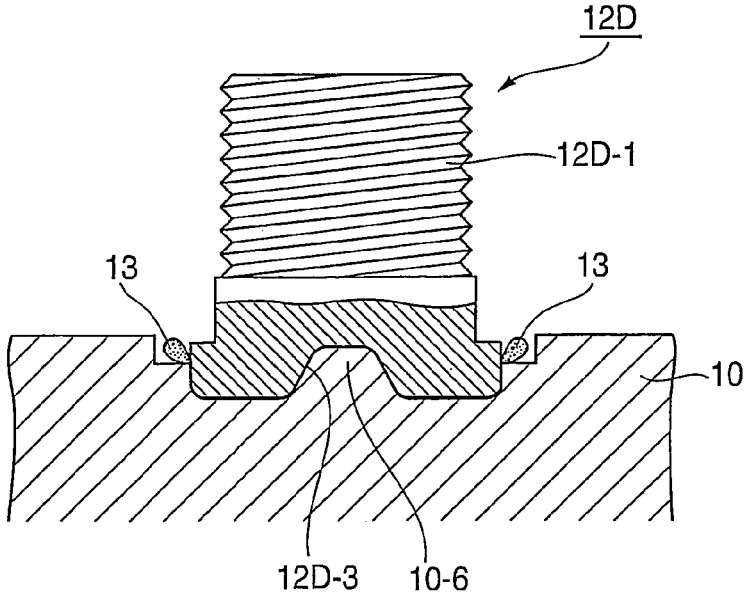
Figure 14:
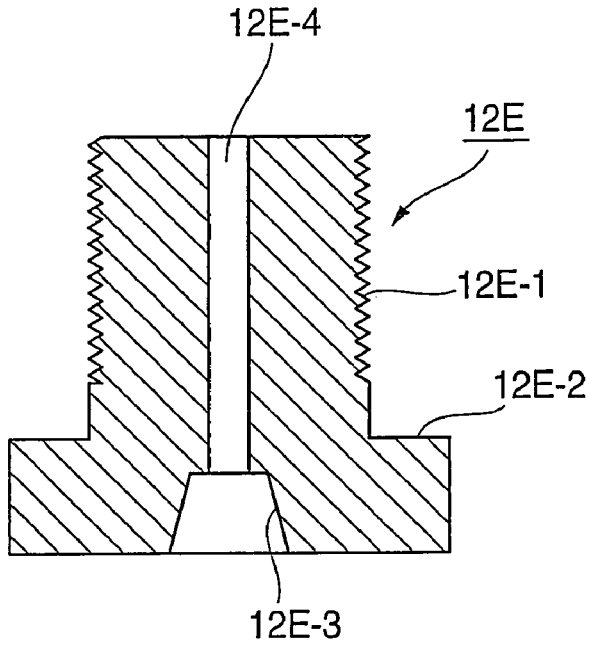
FIG. 14 is a longitudinal sectional view showing another embodiment of the branching connection body shown in FIG. 12.
Figure 15:
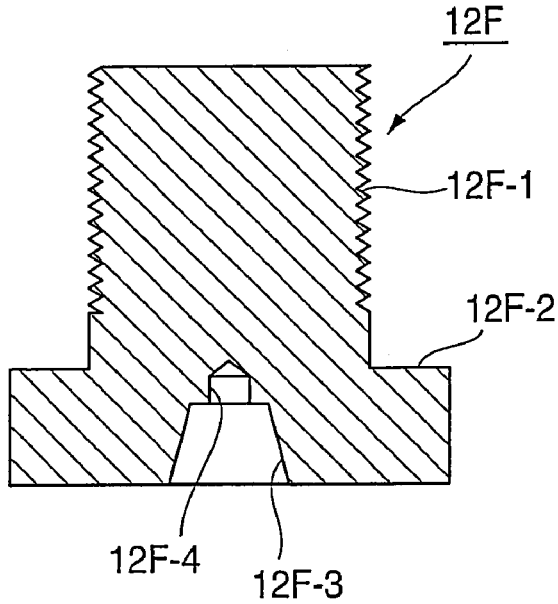
FIG. 15 is a longitudinal sectional front view showing another embodiment of the branching connection body shown in FIG. 12 likewise.
Figure 16:
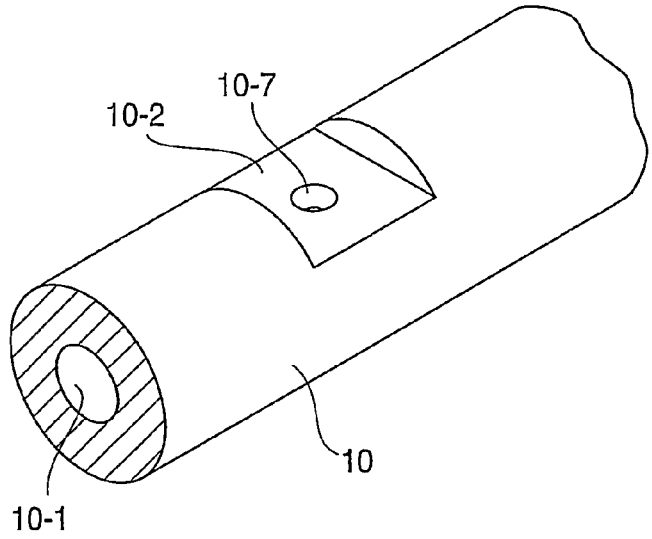
FIG. 16 is a perspective view of a substantial part showing another embodiment of the common rail body according to the invention.
Figure 17:
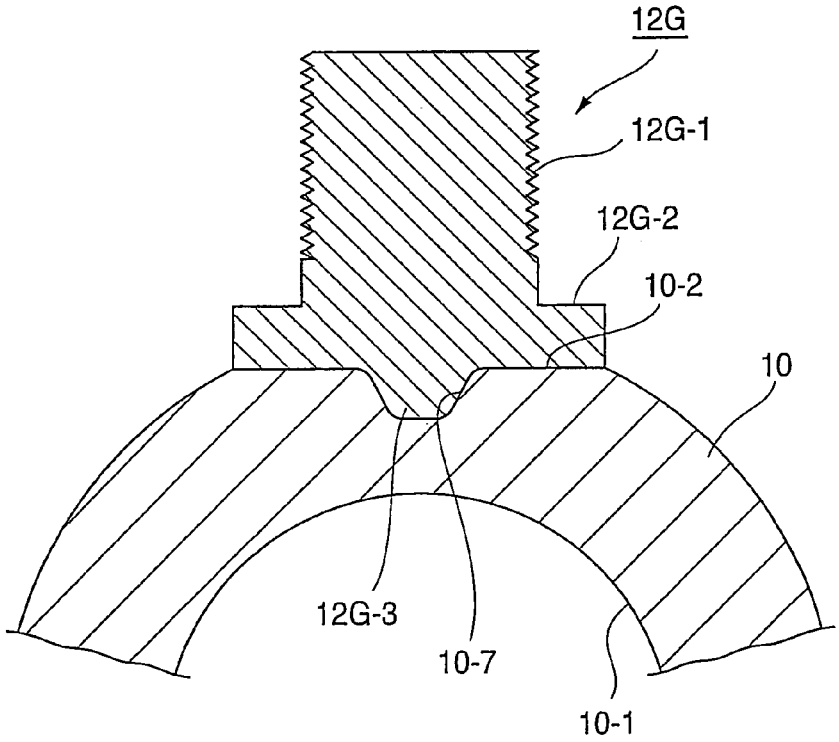
FIG. 17 is a substantial part sectional view showing a ninth embodiment of the common rail that is configured by the common rail body shown in FIG. 16 and the branching connection body pairing the common rail body.
Figure 18A:
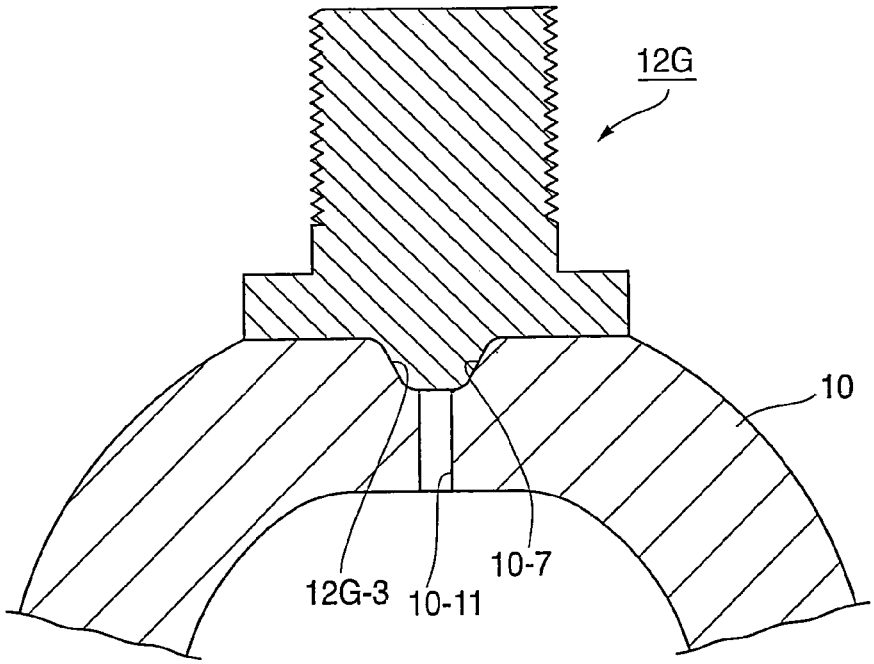
FIGS. 18*a* and 18*b* show another embodiment of the common rail shown in FIG. 17, and FIG. 18*a* and FIG. 18*b* are substantial part sectional views showing a common rail with a through hole for air release and pooling the inclusion disposed at the side of the common rail body and a common rail with a pool for air and the inclusion disposed at the side of the common rail body, respectively.
Figure 18B:
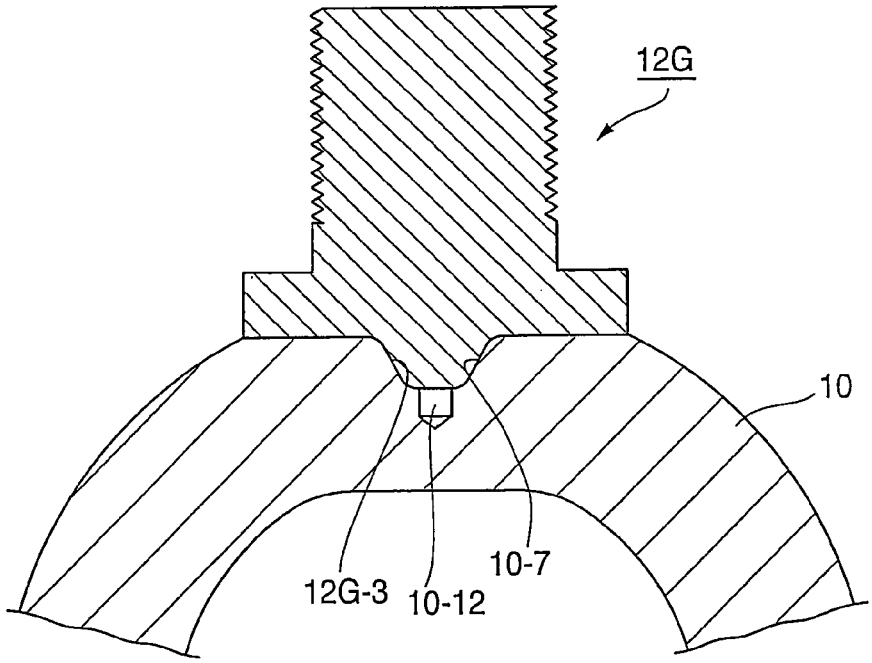
Figure 19:
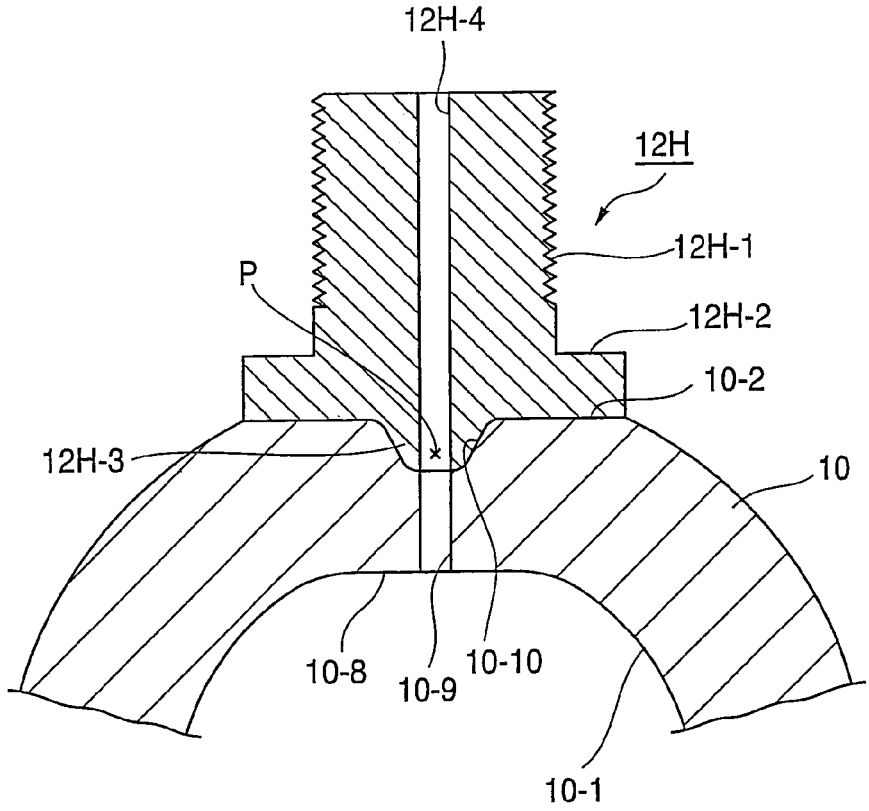
FIG. 19 is a substantial part sectional view showing a tenth embodiment of the common rail shown in FIG. 17 likewise.

FIGS. 1*a* and 1*b* illustrate an embodiment of a branching connection body according to the invention. FIG. 1*a* is a front view showing the branching connection body, in which a confronting face of a common rail body is formed in the shape of a cone with a head mounted thereon whose cone face is a flat face, and FIG. 1*b* is a front view showing the branching connection body, in which the confronting face of the common rail body is formed in the shape of a cone with a head mounted thereon whose cone face is a gentle curved face. FIGS. 2*a* and 2*b* illustrate another embodiment of the branching connection body likewise. In FIGS. 2*a* and 2*b*, FIG. 2*a* is a front view showing the branching connection body, in which a confronting face of a common rail body of a pressure flange part disposed at the confronting part of the common rail body is formed in the shape of a cone with a head mounted thereon whose cone face is a flat face, and FIG. 2*b* is a front view showing the branching connection body, in which the confronting face of the common rail body of the pressure flange part disposed at the confronting part of the common rail body is formed in the shape of a cone with a head mounted thereon whose cone face is a gentle curved face. FIG. 3 is a substantial part sectional view showing a first embodiment of the common rail according to the invention, FIG. 4 is a substantial part sectional view showing a second embodiment likewise, and FIGS. 5 to 8 are substantial part sectional views showing the sate of setup of the other common rail according to the invention. FIG. 5 is a substantial part sectional view showing a third embodiment, FIG. 6 is a substantial part sectional view showing a fourth embodiment, FIG. 7 is a substantial part sectional view showing a fifth embodiment, FIG. 8 is a substantial part sectional view showing a sixth embodiment likewise, FIG. 9 is a substantial part sectional view showing another embodiment of the common rail body according to the invention, FIG. 10 is a sectional view showing a seventh embodiment of the common rail according to the invention using the common rail body shown in FIG. 9, FIG. 11 is a perspective view of a substantial part showing another embodiment of the common rail body according to the invention, FIG. 12 is a front view showing a branching connection body paring the common rail body shown in FIG. 11 partially breaking, and FIGS. 13*a* and 13*b* are views showing an eighth embodiment of the common rail configured by the common rail body shown in FIG. 11 and the branching connection body shown in FIG. 12. In FIGS. 13*a* and 13*b*, FIG. 13*a* is a substantial part sectional view showing the setup state of the common rail and FIG. 13*b* is a substantial part sectional view showing the common rail after the friction welding. FIG. 14 is a longitudinal sectional view showing another embodiment of the branching connection body shown in FIG. 12, FIG. 15 is a longitudinal sectional front view showing another embodiment of the branching connection body shown in FIG. 12 likewise, FIG. 16 is a perspective view of a substantial part showing another embodiment of the common rail body according to the invention, FIG. 17 is a substantial part sectional view showing a ninth embodiment of the common rail configured by the common rail body shown in FIG. 16 and the branching connection body pairing the common rail body, FIGS. 18*a* and 18*b* are substantial part sectional views showing another embodiment of the common rail shown in FIG. 17, and FIG. 19 is a substantial part sectional view showing a tenth embodiment of the common rail shown in FIG. 17 likewise.

Each of branching connection bodies 11A and 11B shown in FIGS. 1A and 1*b* is formed in the shape of a truncated cone whose peripheral part is a gentle cone face with the center part of the confronting face of the common rail body slightly projected. In the branching connection body 11A shown in F*ig*. 1*a*, a projection formed in the shape of a truncated cone whose center part is a flat face 11A-2 and whose peripheral part is a flat face 11A-3 on the confronting face of the common rail body at the lower part of this body with a male screw 11A-1 formed, to which a nut for fastening a branch tube is screwed together at its outer circumference. As same as the above-described branching connection body, in the branching connection body 11B shown in FIG. 1*b*, a projection formed in the shape of a truncated cone whose center part is a flat face 11B-2 and whose peripheral part is a flat face 11B-3 on the confronting face of the common rail body at the lower part of this body with a male screw 11B-1 formed, to which a nut for fastening a branch tube is screwed together at its outer circumference.

According to the invention, the confronting face of the common rail body of the branching connection body is formed in the shape of a truncated whose center part is slightly projected and whose peripheral part is a gentle cone face (a flat face or curved face) because a gap is formed at an end face at the outer circumference side between the confronting faces of a flat face at the side of the common rail body and the branching connection body so as to effectively squeeze out a red heat softened surface layer (the inclusion such as stain and an oxide) due to upset from a friction rotation center part from the gap sufficiently causing heat generation by friction.

In addition, according to the invention, the diameter d of the flat face of the projection shaped in the shape of the cone with a head mounted thereon is made into ⅗ to ⅘ of the diameter D of the branching connection body because a problem is caused such that the initial heat generation by friction cannot be sufficiently obtained and the smooth progress of the friction beat bonding smoothly is difficult when d is less than ⅗ of D and on the other hand, when d is more than ⅘ of D, the heat generation by friction can be sufficiently obtained, however it is difficult to effectively squeeze out them when there are the oxide and inclusion in the vicinity of the center.

Further, an angle θ of the cone face of the projection formed in the shape of the cone with a head mounted thereon is 5 to 10 degrees because it is difficult to make the effective flow of the squeezing out when it is less than 5 degrees and on the other hand, if it is more than 10 degrees, the heat generation by friction is not increased smoothly and the smooth progress of the friction beat bonding is difficult.

In the meantime, the height h of the projection part in the shape of the cone with the head mounted thereon is decided depending on D, d and θ and normally, the height h is preferably 1.0 mm and below.

In addition, branching connection bodies 12A and 12B shown in FIGS. 2*a* and 2*b* cover one having a pressure flange part in the confronting part of the common rail body and the confronting part of the common rail body of the pressure flange part is formed in the shape of the cone with the head mounted thereon whose center part is slightly projected and whose peripheral part is shaped in a gentle cone face. In the branching connection body 12A shown in FIG. 2*a*, a projection part shaped n a cone with a head mounted thereon with a center part defined as a flat face 12A-3 and its peripheral part defined as a flat face 12A-4 is formed on the confronting face of the common rail body of a pressure flange part 12A-2 disposed at the lower part of this body on which a male screw 12A-1 to which a nut for fastening a branch tube is screwed together at its outer circumference, and as same as FIG. 2*a*, in the branching connection body 12B shown in FIG. 2*b*, a projection part shaped in a cone with a head mounted thereon with a center part defined as a flat face 12B-3 and its peripheral part defined as a flat face 12B-4 is formed on the confronting face of the common rail body of a pressure flange part 12B-2 disposed at the lower part of this body on which a male screw 12B-1 to which a nut for fastening a branch tube is screwed together at its outer circumference.

As same as the above-described branching connection bodies shown in FIGS. 1*a* and 1*b*, in these two kinds of branching connection bodies 12A and 12B, in the case that the diameter of the flat face shaped in the cone with the head mounted thereon of the pressure flange part is defined as d1 and the diameter of the pressure flange part is defined as D1, the diameter d of the flat face is made into ⅗ of D1 to ⅘ of D1 and an angle θ1 of the cone face shaped in the cone with the head mounted thereon is made into 5 to 10 degrees because of the same reason as the above-described reason.

Next, the common rail of the first embodiment shown in FIG. 3 is configured by confronting the branching connection body 11A (without a pressure flange part) shown in FIG. 1*a* to a flat face part 10-2 formed on the outer face of the common rail body 10 and pressure-bonding it by the friction welding (friction pressure welding) between one flat face and the other flat face. In the case of this common rail, by forming a gap on the end face at the outer circumferential side between the confronting faces of the flat face part 10-2 at the side of the common rail body 10 and the branching connection body 11A, the pressure bonding between the common rail body 10 and the branching connection body 11A has been progressed and has been completed as a red heat soft surface layer (the inclusion such as stain and an oxide) 13 is effectively squeezed-out due to upset from a friction rotation center part from the gap sufficiently causing heat generation by friction, so that a clean pressure bonding connection fabric can be obtained. 10-1 is a distribution hole of the common rail body 10.

The common rail of the second embodiment shown in FIG. 4 is configured by confronting the branching connection body 12A with a pressure flange part 12A-2 shown in FIG. 2*a* to the flat face part 10-2 formed on the outer face of the common rail body 10 and pressure-bonding it by the friction welding (friction pressure welding) between one flat face and the other flat face. In the case of this common rail, by forming a gap on the end face at the outer circumferential side between the confronting faces of the flat face part 10-2 at the side of the common rail body 10 and the pressure flange part 12A-2 of the branching connection body 12A, as same as the above-described common rail, the pressure bonding between the common rail body 10 and the pressure flange part 12A-2 of the branching connection body 12A has been progressed and has been completed as a red heat soft surface layer (the inclusion such as stain and an oxide) 13 is effectively squeezed-out due to upset from a friction rotation center part from the gap sufficiently causing heat generation by friction, so that a clean pressure bonding connection fabric can be obtained.

In the meantime, it is obvious that the common rail having the same effect and advantage as the above-described common rail can be obtained also in the case that the branching connection bodies 11B and 12B shown in the above-described FIG. 1*b* and FIG. 2*b* are used.

In the common rail in the setup state of the third to sixth embodiments shown in FIGS. 5 to 8, an annular concave part having a flat face with a gentle concave face or with a gentle curved face is formed at the part confronting the end face at the outer circumference side of the branching connection body of the branching connection body fixed face of the common rail body. In the common rail in the upset state of the third embodiment shown in FIG. 5, a male screw 11C-1 to which a nut for fastening a branch tube is screwed together is formed at its outer circumference, by using a branching connection body 11C (without a pressure flange part) whose fixed part is a flat face, an annular concave part 10-3 whose concave face is a gentle flat face is formed at the end face at the outer circumferential side between the confronting faces with the branching connection body 11C of the flat face part 10-2 formed on the outer face of the common rail body 10. The common rail in the upset state of the third embodiment shown in FIG. 5 is configured by confronting the branching connection body 11C to the part of this annular concave part 10-3 and pressure-bonding it by the friction welding (friction pressure welding) between the flat face of the branching connection body 11C and the flat face at the side of the common rail body 10. In this case, even if the fixed face with the common rail body is the branching connection body 11C of the flat face, by forming a gap 14 between the confronting faces between the annular concave part 10-3 formed on the flat face part 10-2 at the side of the common rail body 10 and the flat fixed face of the branching connection body 11C, as same as the above-described common rail, the pressure bonding between the common rail body 10 and the branching connection body 11C has been progressed and has been completed as a red heat soft surface layer (the inclusion such as stain and an oxide) is effectively squeezed-out due to upset from a friction rotation center part from the gap 14 sufficiently causing heat generation by friction, so that a clean pressure bonding connection fabric can be obtained. In the meantime, it is obvious that the annular concave part to be disposed at the side of the common rail body 10 can be a concave part 10-4 with a gentle curved face shown in FIG. 6 and FIG. 8 in place of the annular concave part 10-3 whose annular face is a gentle flat face.

In the common rail in the setup state of the fourth embodiment shown in FIG. 6, the branching connection body 11A shown in FIGS. 1*a* and 1*b* is used as the branching connection body and the annular concave part 10-4 whose concave face is the gentle curved face is formed at the side of the common rail body 10. In the case of this common rail, by forming a gap 15 between the gentle flat face 11A-3 at the side of the branching connection body 11A and the annular concave part 10-4 at the side of the common rail body 10, as same as the above-described common rail, the pressure bonding between the common rail body 10 and the branching connection body 11A has been progressed and has been completed as a red heat soft surface layer (the inclusion such as stain and an oxide) is effectively squeezed-out due to upset from a friction rotation center part from the gap 15 sufficiently causing heat generation by friction, so that a clean pressure bonding connection fabric can be obtained. In the meantime, it is obvious that the annular concave part to be disposed at the side of the common rail body 10 can be the annular concave part 10-3 shown in FIG. 5 whose annular face is a gentle flat face.

In the common rail in the upset state of the fifth embodiment shown in FIG. 7, a male screw 12C-1 to which a nut for fastening a branch tube is screwed together is formed at its outer circumference, by using a branching connection body 12C having a pressure flange part 12C-2 whose fixed part is a flat face at the confronting part of the common rail body, the annular concave part 10-3 whose concave face is a gentle flat face is formed at the side of the common rail body 10. In the case of this common rail body, even if the fixed face with the common rail body of the pressure flange part 12C-2 is the branching connection body 12C of the flat face, by forming a gap 16 between the confronting faces between the annular concave part 10-3 formed on the flat face part 10-2 at the side of the common rail body 10 and the flat fixed face of the branching connection body 12C, as same as the above-described common rail, the pressure bonding between the common rail body 10 and the branching connection body 11C has been progressed and has been completed as a red heat soft surface layer (the inclusion such as stain and an oxide) is effectively squeezed-out due to upset from a friction rotation center part from the gap 16 sufficiently causing heat generation by friction, so that a clean pressure bonding connection fabric can be obtained. In the meantime, it is obvious that the annular concave part to be disposed at the side of the common rail body 10 can be the annular concave part 10-4 whose annular face is a gentle flat face.

In the common rail in the setup state of the sixth embodiment shown in FIG. 8, the branching connection body 12A with the pressure flange part 12A-2 shown in FIGS. 2*a* and 2*b* is used and the annular concave part 10-4 whose concave face is the gentle curved face is formed at the side of the common rail body 10. In the case of this common rail, by forming a gap 17 at the end face at the outer circumferential side between the confronting faces of the annular concave part 10-4 at the side of the branching connection body 10 and the gentle flat face 12A-4 of the pressure flange part 12A-2 at the side of the branching connection body 12A, as same as the above-described common rail, the pressure bonding between the common rail body 10 and the branching connection body 12A has been progressed and has been completed as a red heat soft surface layer (the inclusion such as stain and an oxide) is effectively squeezed-out due to upset from a friction rotation center part from the gap 17 sufficiently causing heat generation by friction, so that a clean pressure bonding connection fabric can be obtained. In the meantime, it is obvious that the annular concave part to be disposed at the side of the common rail body 10 can be the annular concave part 10-3 whose annular face is a gentle flat face.

In the common rail body 10 shown in FIG. 9, a facing hole 10-5 having a diameter larger than the diameter of the connection face of the branching connection body by 3 to 4 mm and with a depth of 1 to 2 mm is formed on the outer face of the common rail body 10 and the branching connection body is firmly fixed at the portion of this facing hole 10-5 so as to configure the common rail. As this common rail, for example, as shown as the seventh embodiment in FIG. 10, it is configured by confronting the branching connection body 12A with the pressure flange part 12A-2 shown in FIG. 2*a* to the flat face part of the facing hole 10-5-formed on the outer face of the common rail body 10 and pressure-bonding it by the friction welding (friction pressure welding) between one flat face and the other flat face. In the case of this common rail, the red heat soft surface layer (the inclusion such as stain and an oxide) 13 is effectively squeezed-out due to upset from a friction rotation center part from a gap formed on the end face at the outer circumferential side between the confronting faces of the flat face part 10-2 at the side of the common rail body 10 and the branching connection body 12A sufficiently causing heat generation by friction to be discharged to the end of the inner circumferential side of the facing hole 10-5, so that a clean pressure bonding connection fabric can be obtained as same as the above-described common rail.

In the meantime, the diameter of the facing hole 10-5 is larger than the diameter of the connection face of the branching connection body by 3 to 4 mm because not only the squeezed-out soft surface layer is not accumulated being smoothly curled when the diameter difference is less than 3 mm and on the other hand, there is no difference in the squeeze out effect of the soft surface layer if the diameter is larger than 4 mm but also it is feared that the number of the processing steps is increased and the thin part of the common rail wall thickness is increased so as to lower the strength of the common rail and deteriorate the durability thereof. In addition, the depth thereof is 1 to 2 mm because it is squeezed-out and the curled soft surface layer is not settled in the part of the facing hole if it is less than 1 mm and on the other hand, the common rail wall part is made thin, the inner pressure fatigue strength is lowered if it is larger than 2 mm and deterioration of the durability is feared.

As shown in FIG. 11, the common rails shown in FIGS. 11 to 13 are configured in such a manner that a projection 10-6 in the shape of a cone with a head mounted thereon is disposed at the side of the common rail body 10 and a concave part 12D-3 in the shape of a cone with a head mounted thereon which the projection 10-6 in the shape of a cone with a head mounted thereon fits is disposed at the side of a branching connection body 12D. More particularly, providing the projection 10-6 in the shape of a cone with a head mounted thereon with a bottom diameter L1, a top diameter L2, and a height H1 at the center part of the flat face part 10-2 formed on the outer face of the common rail body 10, on the other hand, providing a concave part 12D-3 in the shape of a cone with a head mounted thereon whose opening diameter 11, bottom diameter 12, and height h1 are slightly smaller than those of the projection 10-6 in the shape of a cone with a head mounted thereon which the projection 10-6 in the shape of a cone with a head mounted thereon fits at the branching connection body 12D having a pressure flange part. 12D-2 whose confronting part is a flat face at the common rail body confronting part, and allowing a concave part 12D-3 in the shape of a cone with a head mounted thereon provided at the side of the branching connection body 12D to fit the projection 10-6 in the shape of a cone with a head mounted thereon disposed at the side of the common rail body 10, the both are pressure-bonded by the friction welding (friction pressure welding) so as to configure the common rail. By forming a gap 18 between the confronting faces of the flat face part 10-2 at the side of the common rail body 10 and the pressure flange part 12D-2 at the side of the branching connection body 12D, also in the present embodiment, the pressure bonding between the common rail body 10 and the branching connection body 12D has been progressed and has been completed as a red heat soft surface layer (the inclusion such as stain and an oxide) 13 is effectively squeezed-out due to upset from a friction rotation part from the gap sufficiently causing heat generation by friction, so that a clean pressure bonding connection fabric can be obtained.

In order to obtain a more clean pressure bonding connection fabric, a branching connection body 12E shown in FIG. 14 is configured in such a manner that a through hole 12E-4 for air release and pooling the inclusion is disposed at a center axial core part of the branching connection body 12D shown in the above-described FIG. 12. The branching connection body 12E has a pressure flange part 12E-2 whose confronting face is a flat face at the common rail body confronting part at the lower part of the body on which a male screw 12E-1 to which a nut for fastening a branch tube (its illustration is omitted) is formed at its outer circumference, and a through hole 12E-4 with a small diameter is disposed at a bottom center part of a concave part 12E-3 in the shape of a cone with a head mounted thereon which the above-described projection 10-6 in the shape of a cone with a head mounted thereon is disposed at the side of the common rail body 10, namely, at a center axial core part of this branching connection body 12E.

In the case of this branching connection body 12E, due to the effect of the gap 13 formed between the confronting faces of the flat face part 10-2 at the side of the common rail body 10 and the pressure flange part 12E-2 at the side of the branching connection body 12E and the through hole 12E-4 with a small diameter disposed at the center axial core part of this branching connection body 12E, a red heat soft surface layer (the inclusion such as stain and an oxide) 14 is effectively squeezed-out due to upset from a friction rotation center part from the gap sufficiently causing heat generation by friction and the pressure bonding between the common rail body 10 and the branching connection body 12E has been progressed and has been completed as the red heat soft surface layer (the inclusion such as stain and an oxide) 14 is also injected in the through hole 12E-4 with a small diameter disposed at the center axial core part of the branching connection body 12E together with air, so that a more clean pressure bonding connection fabric can be obtained.

In order to obtain a more clean pressure bonding connection fabric as same as the above-described case, a branching connection body 12F shown in FIG. 15 is configured in such a manner that a pool 12F-4 for pooling air and the inclusion is disposed at a center axial core part of the branching connection body 12D shown in the above-described FIG. 12. The branching connection body 12F has a pressure flange part 12F-2 whose confronting face is a flat face at the common rail body confronting part at the lower part of the body on which a male screw 12F-1 to which a nut for fastening a branch tube (its illustration is omitted) is formed at its outer circumference, and the pool 12F-4 for pooling air and the inclusion is disposed at a bottom center part of a concave part 12F-3 in the shape of a cone with a head mounted thereon which the above-described projection 10-6 in the shape of a cone with a head mounted thereon is disposed at the side of the common rail body 10, namely, at a center axial core part of this branching connection body 12F.

In the case of this branching connection body 12F, due to the effect of the gap 13 formed between the confronting faces of the flat face part 10-2 at the side of the common rail body 10 and the pressure flange part 12F-2 at the side of the branching connection body 12F and the pool 12F-4 for pooling air and the inclusion disposed at the center axial core part of this branching connection body 12F, a red heat soft surface layer (the inclusion such as stain and an oxide) 14 is effectively squeezed-out due to upset from a friction rotation center part from the gap sufficiently causing heat generation by friction and the pressure bonding between the common rail body 10 and the branching connection body 12F has been progressed and has been completed as the red heat soft surface layer (the inclusion such as stain and an oxide) 14 is also squeezed out also in the pool 12F-4 for pooling air and the inclusion disposed at the center axial core part of the branching connection body 12F together with air, so that a more clean pressure bonding connection fabric can be obtained.

The common rails shown in. FIGS. 16 to 19 are configured in such a manner that concave parts 10-7 and 10-10 in the shape of an inversed cone with a head mounted thereon are disposed at the side of the common rail body 10 and projections 12G-3 and 12H-3 in the shape of an inversed cone with a head mounted thereon which fit into the above-described concave parts 10-7 and 10-10 in the shape of an inversed cone with a head mounted thereon are disposed at the sides of branching connection bodies 12G and 12H.

As shown in FIG. 16, the common rails shown in FIGS. 16 to 17 are configured in such a manner that the concave 10-7 in the shape of an inversed cone with a head mounted thereon is disposed at the center part of the flat face part 10-2 formed on the outer face of the common rail body 10, on the other hand, as shown in FIG. 17, a projection 12G-3 in the shape of an inversed cone with a head mounted thereon whose size is slightly larger than that of the concave part 10-7 in the shape of an inversed cone with a head mounted thereon which fits into this concave part 10-7 in the shape of an inversed cone with a head mounted thereon is disposed at a branching connection body 12G having a pressure flange part 12G-2 whose confronting part is a flat face at the common rail body confronting part at the lower part of the body on which a male screw 12G-1 to which a nut for fastening a branch tube (its illustration is omitted) is formed at its outer circumference. Allowing a projection 12G-3 in the shape of an inversed cone with a head mounted thereon provided at the side of the branching connection body 12G to fit the concave part 10-7 in the shape of an inversed cone with a head mounted thereon disposed at the side of the common rail body 10, the both are pressure-bonded by the friction welding (friction pressure welding) so as to configure the common rail. By forming a gap between the confronting faces of the flat face part 10-2 at the side of the common rail body 10 and the pressure flange part 12G-2 at the side of the branching connection body 12G, also in the present embodiment, the pressure bonding between the common rail body 10 and the branching connection body 12G has been progressed and has been completed as a red heat soft surface layer (the inclusion such as stain and an oxide) is effectively squeezed-out due to upset from a friction rotation part from the gap sufficiently causing heat generation by friction, so that a clean pressure bonding connection fabric can be obtained.

In the common rail shown in FIGS. 18*a* and 18*b*, the through hole 12E-4 for air release and pooling the inclusion shown in FIG. 14 and the pool 12F-4 for air release and pooling the inclusion shown in FIG. 15 are applied to the common rail shown in FIGS. 16 to 17, and the common rail shown in FIG. 18*a* indicates a common rail that a through hole 10-11 equivalent to the through hole 12E-4 for air release and pooling the inclusion shown in FIG. 14 is disposed at the side of the common rail body 10 and the common rail shown in FIG. 18*b* indicates a common rail that a pool 10-12 equivalent to the pool 12F-4 for air release and pooling the inclusion shown in FIG. 15 is disposed at the side of the common rail body 10, respectively.

In the case of the common rail shown in FIG. 18*a*, a red heat soft surface layer (the inclusion such as stain and an oxide) 14 is effectively squeezed-out due to upset from a friction-rotation center part from the gap and the pressure bonding between the common rail body 10 and the branching connection body 12G has been progressed and has been completed as the red heat soft surface layer (the inclusion such as stain and an oxide) 14 is also injected in the through hole 10-11 disposed at the common rail body 10 together with air, so that a more clean pressure bonding connection fabric can be obtained.

Further, in the case of the common rail shown in FIG. 18*b*, a red heat soft surface layer (the inclusion such as stain and an oxide) 14 is effectively squeezed-out due to upset from a friction rotation center part from the gap and the pressure bonding between the common rail body 10 and the branching connection body 12G has been progressed and has been completed as the red heat soft surface layer (the inclusion such as stain and an oxide) 14 is also injected in the pool 10-12 for air and the inclusion disposed at the common rail body 10, so that a more clean pressure bonding connection fabric can be obtained.

The common rail shown in FIG. 19 is configured in such a manner that a concave part 10-10 in the shape of an inversed cone with a head mounted thereon is disposed at the center part of the flat face part 10-2 formed on the outer face of the common rail body 10 having a flat face 10-8 on the inner peripheral wall around a branching hole 10-9 communicated with the inner through hole 10-1; on the other hand, a branching connection body 12H having a through hole 12H-4 communicated with the branching hole 10-9 at the center axial core part and having a pressure flange part 12H-2 whose confronting part is a flat face at the common rail body confronting part at the lower part of the body on which a male screw 12H-1 to which a nut for fastening a branch tube (its illustration is omitted) is formed at its outer circumference is made of a high fatigue strength steel such as SCM, SNCM, and a maraging steel; a projection 12H-3 in the shape of an inversed cone with a head mounted thereon, whose base diameter and end face diameter are slightly smaller than those of the concave part 10-5 in the shape of an inversed cone with a head mounted thereon fitting the concave part 10-10 in the shape of an inversed cone with a head mounted thereon is disposed at this branching connection-body 12H; and a projection 12H-3 in the shape of an inversed cone with a head mounted thereon disposed at the side of the branching connection body 12H is allowed to fit the concave part 10-10 in the shape of an inversed cone with a head mounted thereon disposed at the side of the common rail body 10 so as to pressure-bond the both by the friction welding (friction pressure welding). Also according to the present embodiment, by forming a gap between the confronting faces between the flat face part 10-2 at the side of the common rail body 10 and the flat face of the pressure flange part 12H-2 at the side of the branching connection body 12H, the pressure bonding between the common rail body 10 and the branching connection body 12H has been progressed and has been completed as a red heat soft surface layer (the inclusion such as stain and an oxide) is effectively squeezed-out due to upset from a friction rotation center part from the gap sufficiently causing heat generation by friction, so that a clean pressure bonding connection fabric can be obtained. Further, in the case of this common rail, since the branching connection body 12H is made of a high fatigue strength steel such as SCM, SNCM, and a maraging steel and the inner circumferential wall face around the branching hole 10-9 is made into the flat face 10-8, the highest pressure generation position P generated at the opening end of the distribution path 10-1 of the branching hole 10-9 moves to the side of the projection 12H-3 in the shape of an inversed cone with a head mounted thereon of the branching connection body 12H when an injection tube (not illustrated) is attached to the branching connection body 12H and the high pressure is activated, so that the common rail having the excellent duration inner pressure fatigue property can be obtained.

In the meantime, according to each of the above-described common rails of the invention, the common rail body upon the friction welding (friction pressure welding) of the branching connection body may be configured by the thick steel tube, solid core round bar, thick steel tube formed boring the solid core round bar or seamless thick steel tube and a distribution hole may be bored after friction pressure bonding the branching connection body. In addition the branching connection body may be any of the solid core body having no through hole communicating with the common rail body, having only a pressure receiving bearing surface opening to the outside formed thereon, or the solid core body having a through hole bored thereon, or a male screw, a round bar having no through hole processed thereon or a round bar with a flange. In addition, here, an example of the pressure welding part that is configured only by the pressure bonding part by the friction welding method is illustrated, however, as described above, there is also the welding part having a partial base material melted at the pressure welding part by the friction welding method and it is obvious that the invention also includes them.

EMBODIMENT(S)

The embodiment that the common rail shown in FIG. 10 is manufactured by the friction welding method (friction pressure welding method) is indicated below. The manufacturing conditions of the present embodiment are shown in a table 1 and a relation between the upset amount, the hydraulic pressure, and the time is shown in FIG. 20, respectively.

Figure 20:
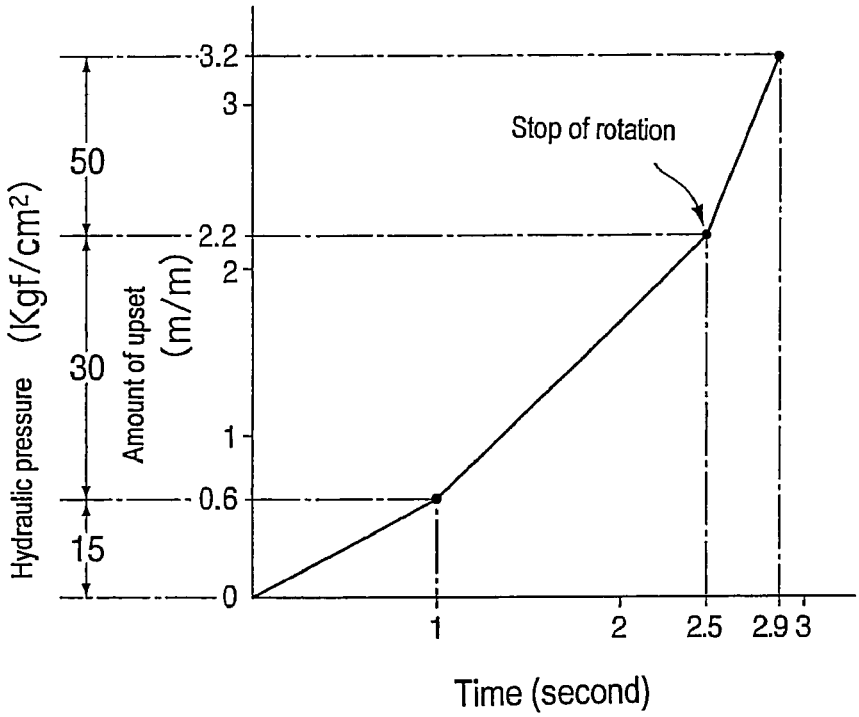
FIG. 20 is a view showing a relation between the amount of upset, a hydraulic pressure, and a time according to the invention.
Figure 21:
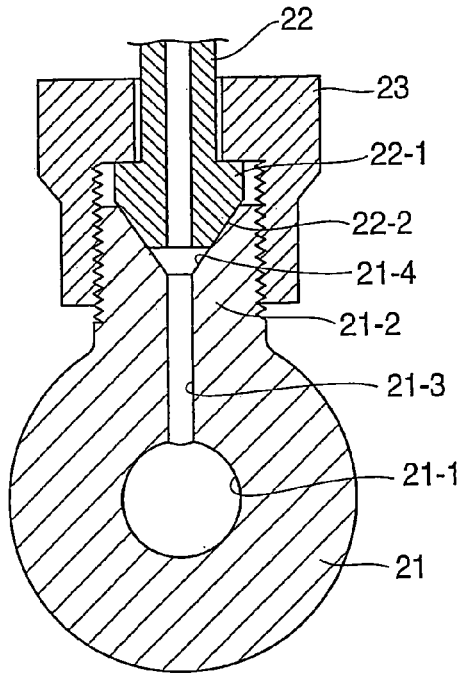
FIG.21 PRIOR ART
FIG. 21 is a longitudinal sectional view showing an example of a conventional common rail.
Figure 22:
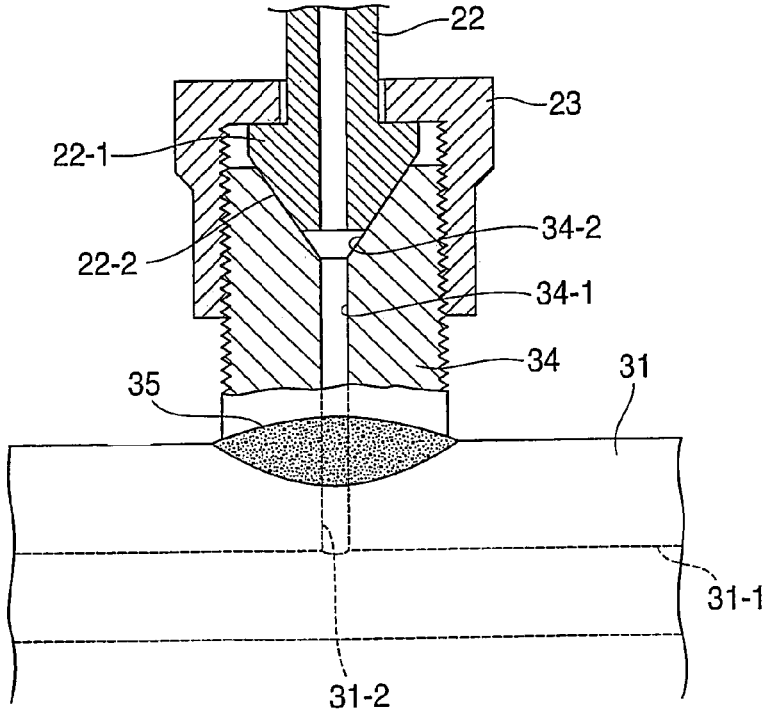
FIG.22 PRIOR ART
FIG. 22 is a partially broken side view showing an example of the conventional common rail covered by the invention.
Figure 23:
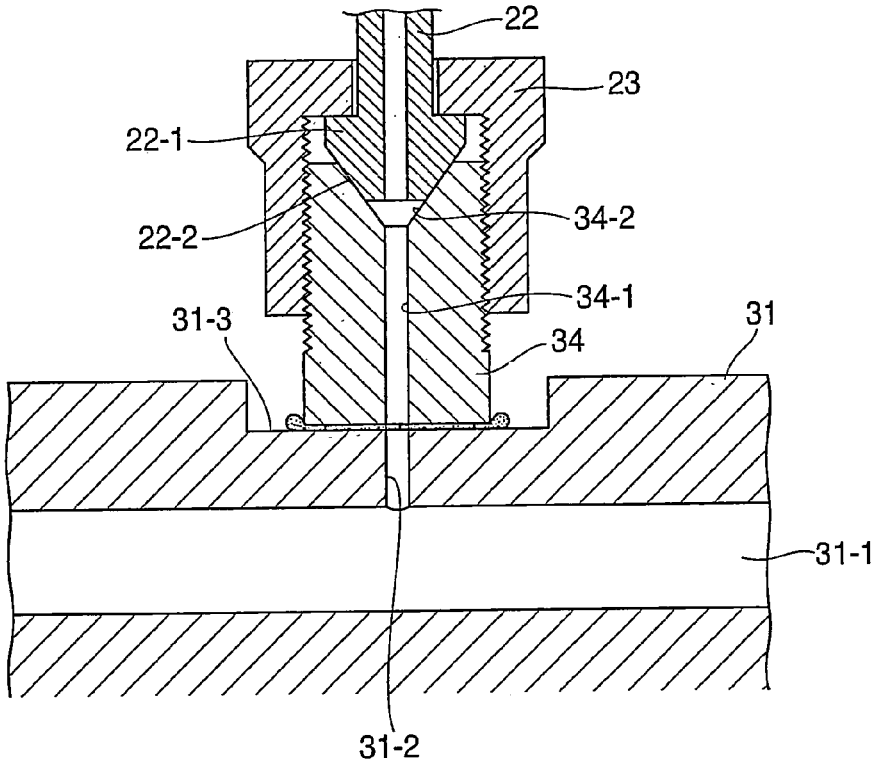
FIG.23 PRIOR ART
FIG. 23 is a longitudinal sectional view showing another example of the conventional common rail covered by the invention.

As a result of manufacturing the common rail on the conditions shown in the table 1 and FIG. 20, a very excellent pressure welding part can be obtained because the void and the inclusion or the like are hardly found on the friction welding face between the common rail body and the branching connection body. In addition, as shown in FIG. 10, the squeezed out flash is evenly curled and the half of the curling sinks in the facing hole without burr.

TABLE 1

| | |
|---|---|
| Common rail body | Material: S45C,<br>Diameter: 32.0 mm,<br>Inner diameter: 10.0 mm,<br>Flat face width: 26 mm,<br>Facing diameter: 24 mm,<br>Depth of facing: 1.5 mm, |
| Branching connecting body | Material: WELTEN 780, Solid core material<br>Diameter of body: 16 mm,<br>Entire height: 25 mm,<br>Diameter of Pressure flange part D1: 20 mm,<br>Diameter of flat face d1: 15 mm,<br>Height of projection part (taper part) h: 0.5 mm |
| Number of rotation of Branching connection body | 2,800 rpm |
| Amount of Total upset | 3.2 mm |
| Amount of upset, hydraulic pressure, and time | Hydraulic pressure from 0.0 to 0.6 mm: 15 Kgf/cm$^2$<br>Time: 0 to 1.0 second<br>Hydraulic pressure from 0.6 to 2.2 mm: 30 Kgf/cm$^2$<br>Time: 1.0 to 2.5 second<br>Hydraulic pressure from 2.2 to 3.2 mm: 50 Kgf/cm$^2$<br>Time: 2.5 to 2.9 second |

According to the invention, a common rail having a bonding part having an excellent durability against the outer force such as oscillation, the inner pressure, and bending and with a high degree of accuracy can be realized. In addition, the invention can be applied not only to a common rail such as a high-pressure fuel manifold in an accumulator system fuel injection system of a diesel internal combustion engine but also to a connection structure in the other high pressure accumulation means.

What is claimed is:

1. A common rail for a diesel engine comprising: a common rail body having an outer peripheral surface, a branch connection seat formed on the peripheral surface, at least a portion of the branch connection seat being substantially flat; a branching connection body having an end face, at least a portion of the end face of the branching connection body being substantially flat, the end face of the branching connection body being opposed to the branch connection seat of the common rail body; at least a portion of at least one of the branch connection seat of the common rail body and the end face of the branching connection body being non-planar and configured to define an annular gap between the branch connection seat and the end face; and a friction welding material securing at least part of the flat portion of the branch connection seat to at least part of the flat portion of the end face of the branching connection body to one another and substantially filling the gap for firmly fixing the branching connection body to the common rail body by friction welding.

2. The common rail of claim 1, wherein the branching connection body includes an outer peripheral surface extending from the end face, the flat portion of the end face being spaced inwardly from the outer peripheral surface of the branching connection body, portions of the end face outwardly from the flat portion of the end face being tapered away from the branch connection seat of the common rail body to define at least a portion of the gap.

3. The common rail of claim 2, wherein the tapered portion of the end face defines a truncated conical surface.

4. The common rail of claim 2, wherein the tapered surface of the end face is a curved surface.

5. The common rail of claim 2, wherein the outer peripheral surface of the branching connection body is substantially cylindrical and defines an outside diameter D, the flat portion of the end face of the branching connection body being substantially circular and having a diameter d of between 0.6D and 0.8D.

6. The common rail of claim 2, wherein the tapered portion of the end face of the branch extension body is aligned to the flat portion of the end face of the branching connection body at an angle of between 50° and 100°.

7. The common rail of claim 2, wherein the branching connection body includes a flange, the end face and portions of the outer peripheral surface adjacent the end face being on the flange, portions of the branch connection body adjacent the flange being cross-sectionally smaller than the flange.

8. The common rail of claim 1, wherein the branch connection seat includes an annular recess surrounding the flat portion of the branch connection seat and defining at least a portion of the gap.

9. The common rail of claim 1, wherein the branch connection seat of the common rail body includes a truncated conical projection extending from the flat portion of the branch connection seat, the end face of the branching connection body including a truncated conical recess spaced inwardly from the flat portion of the end face, the truncated conical recess in the end face of the branching connection body being configured to nest over the truncated conical projection of the branch connection seat, the gap being defined between the flat portion of the branch connection seat and the flat portion of the end face of the branching connection body.

10. The common rail of claim 9, wherein the truncated conical projection on the branch connection seat defines a height, and the truncated conical recess in the end face of the branching connection body defines a depth that is less than the height of the projection so that the gap is defined when the truncated conical projection is nested with the truncated conical recess.

11. The common rail of claim 1, wherein the branching connection body is made of a high fatigue strength steel.

12. The common rail of claim 1, wherein at least one of the common rail body and the branching connection body is formed with a through hole for accommodating air release and pooling during friction welding.

13. The common rail of claim 1, wherein the branching connection body is formed with an array of external threads thereon at locations spaced from the end face.

14. An assembly for forming a common rail, the assembly comprising: a common rail body having an outer peripheral surface and a branch connection seat formed on the outer peripheral surface, at least a portion of the branch connection seat being substantially flat; a branching connection body having an end face, at least a portion of the end face of the branching connection body being substantially flat; central portions of the end face of the branching connection body and central portions of the branch connection seat of the common rail body being configured to define an engagement between the branching connection body and the common rail body; and portions of at least one of the end face of the branching connection body and the branch connection seat of the common rail body being configured to define a substantially annular gap surrounding the engagement between the branching connection body and the common rail body, whereby the annular gap accommodates softened surface layer material of at least one of the common rail body and the branching connection body generated during friction welding of the branching connection body to the common rail body.

* * * * *